US005632189A

United States Patent [19]

Larson

[11] Patent Number: 5,632,189

[45] Date of Patent: May 27, 1997

[54] SAW SHIFTING APPARATUS

[75] Inventor: William A. Larson, Portland, Oreg.

[73] Assignee: New Venture Manufactururing & Service, Inc., Portland, Oreg.

[21] Appl. No.: 404,162

[22] Filed: Mar. 14, 1995

[51] Int. Cl.[6] ..... B27B 5/34

[52] U.S. Cl. ..... 83/508.2; 83/425.4; 83/504; 83/508.3; 83/698.61

[58] Field of Search ..... 83/425.4, 499, 83/504, 508.2, 508.3, 698.61

[56] References Cited

U.S. PATENT DOCUMENTS

| | | | |
|---|---|---|---|
| 3,202,189 | 8/1965 | Pearson . | |
| 3,750,513 | 8/1973 | Cromeens | 83/499 X |
| 4,414,875 | 11/1983 | Pearson | 83/508.3 |
| 5,036,741 | 8/1991 | Scott | 83/504 X |
| 5,293,798 | 3/1994 | Otani et al. | 83/508.3 X |
| 5,325,751 | 7/1994 | Green et al. | 83/508.3 X |

*Primary Examiner*—Eugenia Jones
*Attorney, Agent, or Firm*—Klarquist, Sparkman Campbell Leigh & Whinston, LLP

[57] ABSTRACT

Saw apparatus including an elongate power-driven saw arbor and a circular saw-supporting collar encircling the arbor and axially slidable thereon. The collar is moved axially on the arbor to shift the position of the saw by an elongate compression-transmitting shifter bar received in a peripheral channel in the arbor. A detent plate is attached to the shifter bar. The plate rides in an interior portion of the arbor channel of greater width than the main portion thereof, so it can restrain centrifugal force-induced radial motion of the shifter bar with respect to the arbor during rotation thereof. The shifter bar is of generally rectangular cross-section, and has radially extending recesses therein. The bar is connected to a shifter mechanism by a shoulder bolt, the shoulder of which is received in complementary cylindrical recesses in one end of the shifter bar and in a sleeve in the shifter mechanism, whereby the bolt permits no axial or circumferential movement between bar and shifter mechanism. The opposite end of the shifter bar is received in a slot extending between opposed faces of the saw-supporting collar. This end also includes a pair of detents, one each being disposed at each end of the slot, whereby this end of the shifter bar is connected to the saw-supporting collar with no axial or circumferential movement possible therebetween. The saw-supporting collar includes an annular portion which supports the saw at the precise axial midpoint thereof.

8 Claims, 4 Drawing Sheets

SAW SHIFTING APPARATUS

FIELD OF THE INVENTION

This invention relates to saw apparatus and, more particularly, to such apparatus which includes multiple saws mounted on a saw arbor with the saws being laterally adjustable on the arbor. Saw apparatus of this type is exemplified by a so-called gang rip saw, which includes multiple circular saws adjustable along an arbor and laterally of each other to change the width of boards cut by a machine.

In Pearson, U.S. Pat. No. 3,202,189, a rip saw was disclosed that includes an elongate power-driven saw arbor which is splined, i.e., provided with elongate channels or key ways extending axially therealong. Saw collars encircling the arbor and used to mount circular saws were disclosed as axially movable along the arbor. A pair of rigid shifter bars, seated within the channels on diametrically opposite sides of the arbor, were disclosed as joined at one of their ends to each saw collar. The bars were attached at their opposite ends to a shifter mechanism. Movement of a collar along the arbor was achieved through movement of the shifter mechanism in a direction extending axially of the arbor, and this movement was transmitted by the two shifter bars to the collar secured to their other ends. The shifter bars also provided the means for transmitting the rotation of the saw arbor to the saw collars to which the bars were attached.

The '189 patent apparatus was, however, subject to multiple problems. The channels in the arbor were disclosed as trapezoidal in cross-section as were the shifter bars themselves. Because of the shifter bars' greater mass further from the axis of rotation and the absence of any radial restraint, centrifugal force would cause the bars to bow outwardly during operation. This resulted in a shortening of the desired spacing as respects a particular saw collar. If the apparatus were adjusted to achieve a desired spacing when rotating at, for example, 3600 RPM, a reduction in rotation to 3450 RPM as would result when cutting commenced, would itself result in a change in saw spacing.

In an attempt to alleviate such centrifugal force-caused bowing, the '189 patent design was changed to that disclosed in subsequent Pearson U.S. Pat. No. 4,414,875 as shown, in particular, in FIG. 6 thereof. In this latter design, each shifter bar was provided with a wide, but thin, cross-section so that it could ride within a wide intermediate portion of the arbor channel, which effectively converted the channel to one having a T-shape, thereby to mitigate the centrifugal force-bowing problem. However, having the shifter bar itself ride in an inner slot of reduced depth increased friction, thereby to result in binding during operation. In a further attempt to alleviate these problems, the '875 patent disclosed attaching each shifter bar to its respective collar at only a single anchoring connection, such that centrifugal force would then cause the collar and saw mounted thereon always to maintain a position allegedly normal to the arbor axis. Even this construction, however, was subject to problems, because the entire length of each shifter bar had to ride in the confined T-slot provided in each arbor channel, thereby to result in as much friction as occurred theretofore.

Accordingly, it is the principal object of the present invention to provide a saw shifting apparatus that will eliminate the centrifugal force problem which has plagued the prior designs, yet which will not have the friction problems that previously inhibited saw shifting at high rotational speeds.

It is a further object of the present invention to provide saw shifting apparatus of the above type wherein the shifter bar itself is of reduced mass, thereby to minimize centrifugal force problems.

It is a still further object of the present invention to provide saw shifter apparatus of the above type wherein the attachments of each shifter bar itself to the respective saw-supporting collar and the shifter mechanism are provided with a zero slack connection, thereby to achieve precise saw spacing notwithstanding the speed of axial rotation.

SUMMARY OF THE INVENTION

The saw apparatus to which this invention pertains typically includes an elongate power-driven saw arbor, a circular saw-supporting collar and a shifter mechanism, each of which is slidably mounted on the arbor. At least one elongated compression-transmitting shifter bar extends axially of the arbor and is connected at one end to the shifter mechanism and at the opposite end to the saw-supporting collar. The arbor includes at least one peripheral channel extending axially thereof. The channel has an exterior portion joining the periphery of the arbor and an interior portion of greater width than the exterior portion, the exterior and interior portions creating a generally T-shaped configuration, and the shifter bar is disposed within the channel.

I achieve the foregoing objects of my invention by providing at least one guide or detent plate attached to each shifter bar intermediate its ends, and the length of such guide plate is substantially less than the length of the shifter bar. The guide plate is adapted to ride in the greater width interior portion of the channel, whereby the plate itself serves to restrain centrifugal force-induced radial motion of the shifter bar with respect to the arbor during rotation thereof.

Preferably, my shifter bar is of generally rectangular cross-section and has at least two radially extending recesses therein, the recesses being disposed axially on opposed sides of the guide plate.

The shifter mechanism or shifter comprises an inner or interior sleeve encircling the arbor. I provide a radially extending cylindrical recess in the one end of the shifter bar connected to the shifter mechanism and a corresponding radially extending cylindrical recess in the shifter sleeve. A pin member is received in the cylindrical recesses in the one end of the shifter bar and in the shifter sleeve, whereby the pin member connects the one end of the shifter bar to the shifter sleeve with no possible axial or circumferential movement therebetween.

Preferably, the pin member comprises the shoulder of a shoulder bolt, the shoulder being received in the cylindrical recesses in the one end of the shifter bar and in the shifter sleeve.

I provide the opposite end of the shifter bar, which is connected to the saw-supporting collar, with a solid rectangular cross-section. The saw-supporting collar is formed with an axially extending rectangular slot extending between its opposed faces. Such opposite end of the shifter bar is received in the slot, whereby such end is connected to the saw-supporting collar with no possible circumferential movement therebetween.

Furthermore, I provide such opposite end of the shifter bar connected to the saw-supporting collar with a pair of shoulders or detents, one each of the detents being disposed at each end of the axially extending slot in the saw-supporting collar, such that each of the detents engages an opposed face of the collar. In this manner, the end of the shifter bar connected to the saw-supporting collar can have no axial movement with respect to the saw-supporting collar as well as no circumferential movement therebetween.

Finally, I mount each saw blade at the axial midpoint of the saw-supporting collar which provides proper balance to the saw and the collar such that the saw does not "corkscrew" during rotation of the arbor.

DETAILED DESCRIPTION OF THE PREFERRED EMBODIMENT

Figure 1:
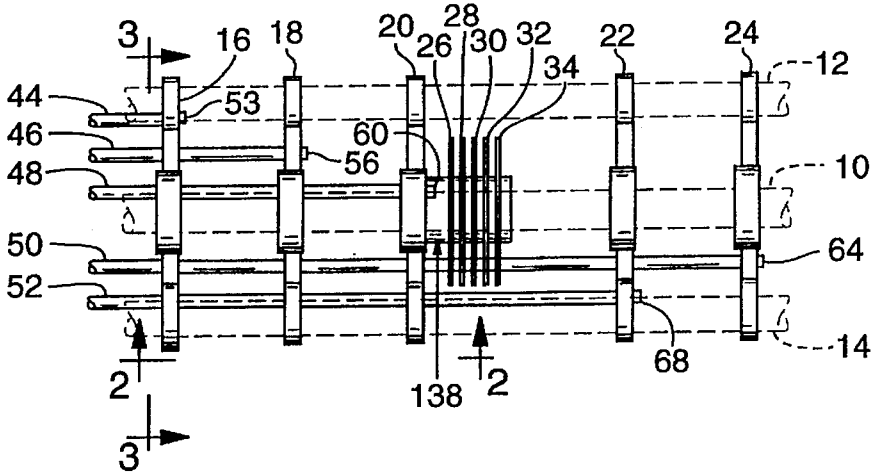
FIG. 1 is a simplified view, illustrating diagrammatically portions of a rip saw machine and, more particularly, the arbor, shifter mechanisms and saws that typically make up such a machine.

Referring to the drawings and particularly to FIG. 1, a rip saw apparatus suitable for use with the present invention comprises a power-driven elongate saw arbor 10 and, disposed on both sides thereof, elongate support shafts 12 and 14. Shifter mechanisms or shifters are indicated generally at 16, 18, 20, 22 and 24. Circular saws encircling arbor 10 and rotated thereby are indicated at 26, 28, 30, 32 and 34. Shifter mechanisms 16, 18 and 20 are positioned to one side of saws 26, 28, 30, 32 and 34; shifter mechanisms 22 and 24 are positioned to the other side thereof.

Figure 3:
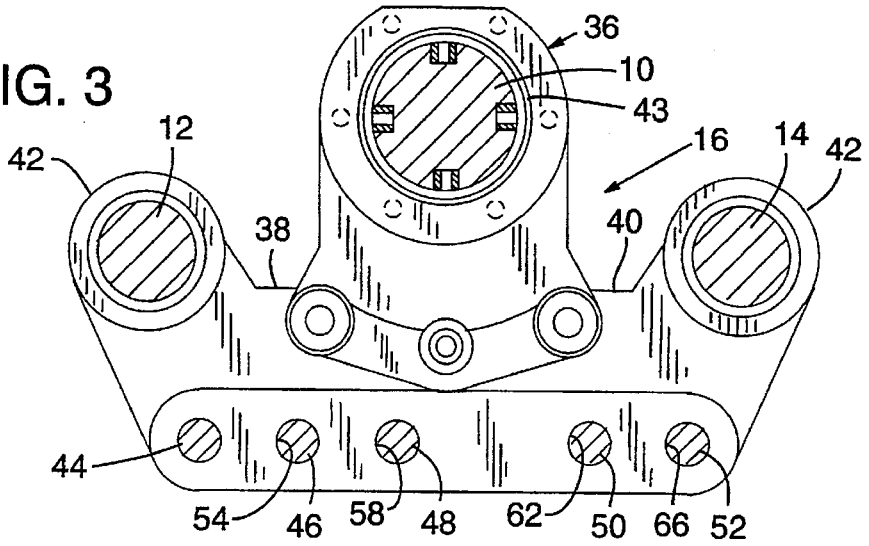
FIG. 3 is a view taken on line 3—3 of FIG. 1 and illustrating a portion of a shifter mechanism.

Shifter mechanisms 16, 18, 20, 22 and 24 are illustrated in FIG. 1 in simplified block form and are shown in more detail in FIG. 3. Each shifter mechanism includes a central arbor-encircling portion 36 and outwardly projecting arm portions 38, 40 which include, at their outer extremities, additional sleeve portions 42 which encircle shafts 12, 14, as shown. Bearing assemblies 43 are interposed between central portion 36 of the shifter mechanisms and arbor 10 which passes therethrough and provide rotatable support for the arbor. In this way, arbor 10 is rotatably supported intermediate its ends by shifter mechanisms 16, 18, 20, 22 and 24; and the shifter mechanisms themselves are supported on shafts 12, 14, as shown.

A conventional set works (not shown), including the usual fluid-operated rams, is provided to shift rods 44, 46, 48, 50 and 52 selectively in an axial direction. Each shifter rod is connected to a respective shifter mechanism. Specifically, rod 44 is connected to shifter mechanism 16 at connection 53; rod 46 passes through a bore 54 in shifter 16 to a connection 56 with shifter mechanism 18. Rod 48 passes through a bore 58 in shifter mechanism 16, and through a similar bore in shifter mechanism 18 to a connection 60 with shifter mechanism 20; rod 50 passes through a bore 62 in shifter mechanism 16 and through similar bores in shifter mechanisms 18, 20 and 22 to a connection 64 with shifter mechanism 24; and rod 52 passes through a bore 66 in shifter mechanism 16 and through similar bores in shifter mechanisms 18 and 20 to a connection 68 with shifter mechanism 22.

Each of shifter mechanisms 16, 18, 22 and 24 is connected by a shifter bar, to be described in greater detail, to a circular saw-supporting collar mounting, respectively, each of saws 28, 30, 32 and 34. The connection is such that on movement of the shifter mechanism axially with respect to the arbor, corresponding movement is produced in the saw-supporting collar and saw associated with the particular shifter mechanism. (The connection between shifter mechanism 20 and saw 26 is configured differently and will be described hereinafter.)

Figure 2:
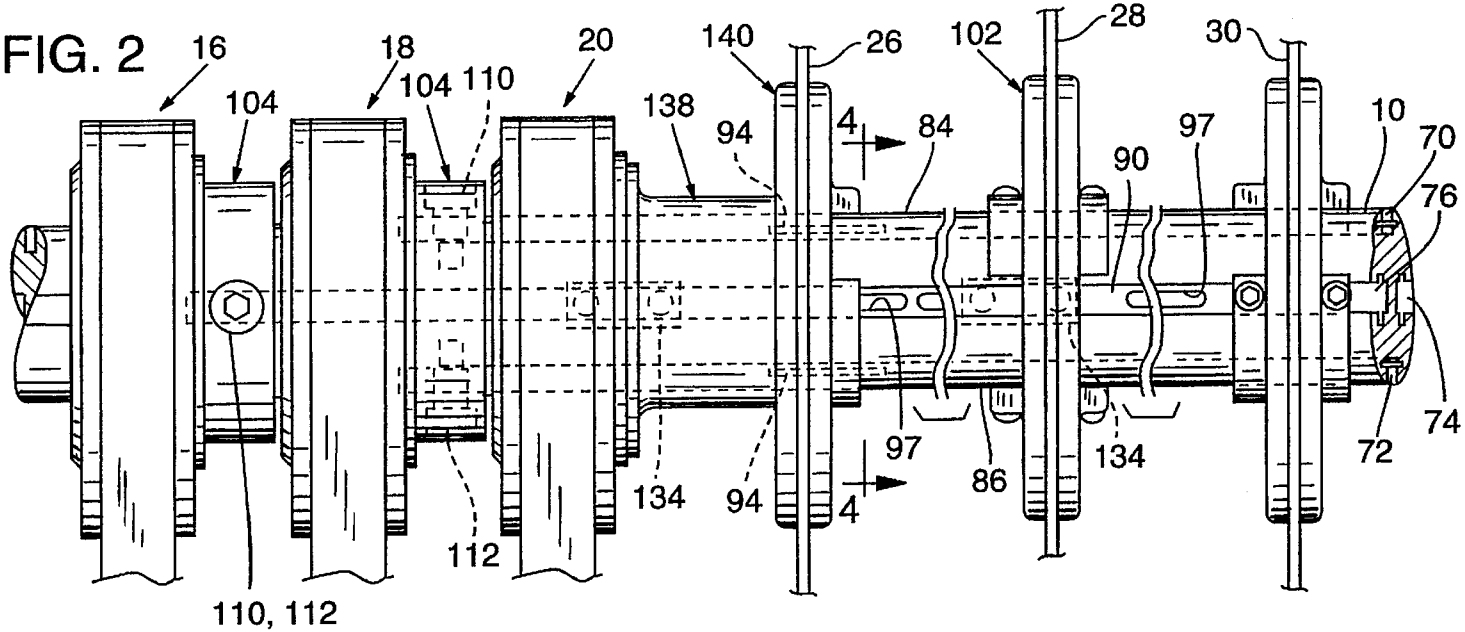
FIG. 2 is a view taken on line 2—2 of FIG. 1, to an enlarged scale and in more detail, illustrating portions of the saw arbor in the machine, some of the collars mounting the saws, and some of the shifter mechanisms utilized in adjusting the positions of the collars.

Connection of the shifter mechanisms to the saw-supporting collars by the shifter bars is shown in greater detail in FIG. 2. FIG. 2 is a side elevation of portions of arbor 10, and illustrates the arbor-encircling portions of shifter mechanisms 16, 18 and 20. Shifter mechanisms 16, 18 and 20 are shown relatively close together in FIG. 2, which is a position they take when saws 26, 28 and 30 are spread apart.

Figure 4:
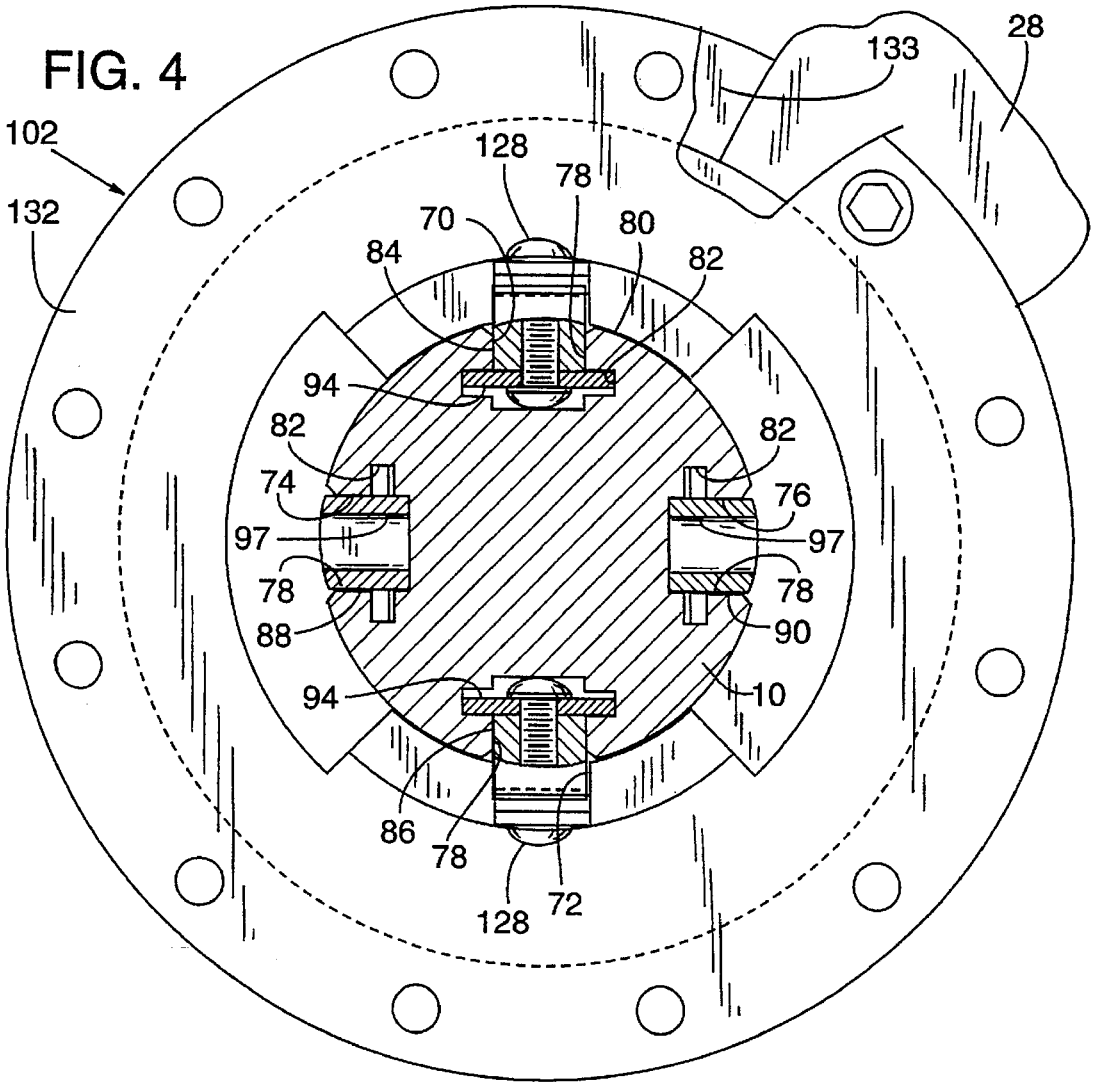
FIG. 4 is a cross-sectional view, taken on line 4—4 of FIG. 2, and illustrating a portion of a saw-supporting collar.

With further reference to FIG. 4 and as is typical with rip saw apparatus of this type, arbor 10 is provided on diametrically opposite sides with elongate keyways or channels indicated generally at 70, 72 (for shifter mechanism 18 and saw 28) and 74, 76 (for shifter mechanism 16 and saw 30). Each of channels 70, 72, 74 and 76 has the same cross-sectional configuration, which includes an outer or exterior portion 78, which joins the periphery 80 of arbor 10, and an interior portion 82 which is wider than exterior portion 78, as shown.

A pair of generally rectangular cross-section shifter bars 84, 86, which connect shifter mechanism 18 and saw 28 (in a manner to be hereinafter described), are seated within exterior portions 78 of channels 70 and 72. Similarly, shifter bars 88, 90, which connect shifter mechanism 16 and saw 30, are seated within exterior portion 78 of channels 74 and 76. Bars 84, 86, 88 and 90 are slidable along the length of channels 70, 72, 74 and 76, as is typical in apparatus of this type.

Figure 5:
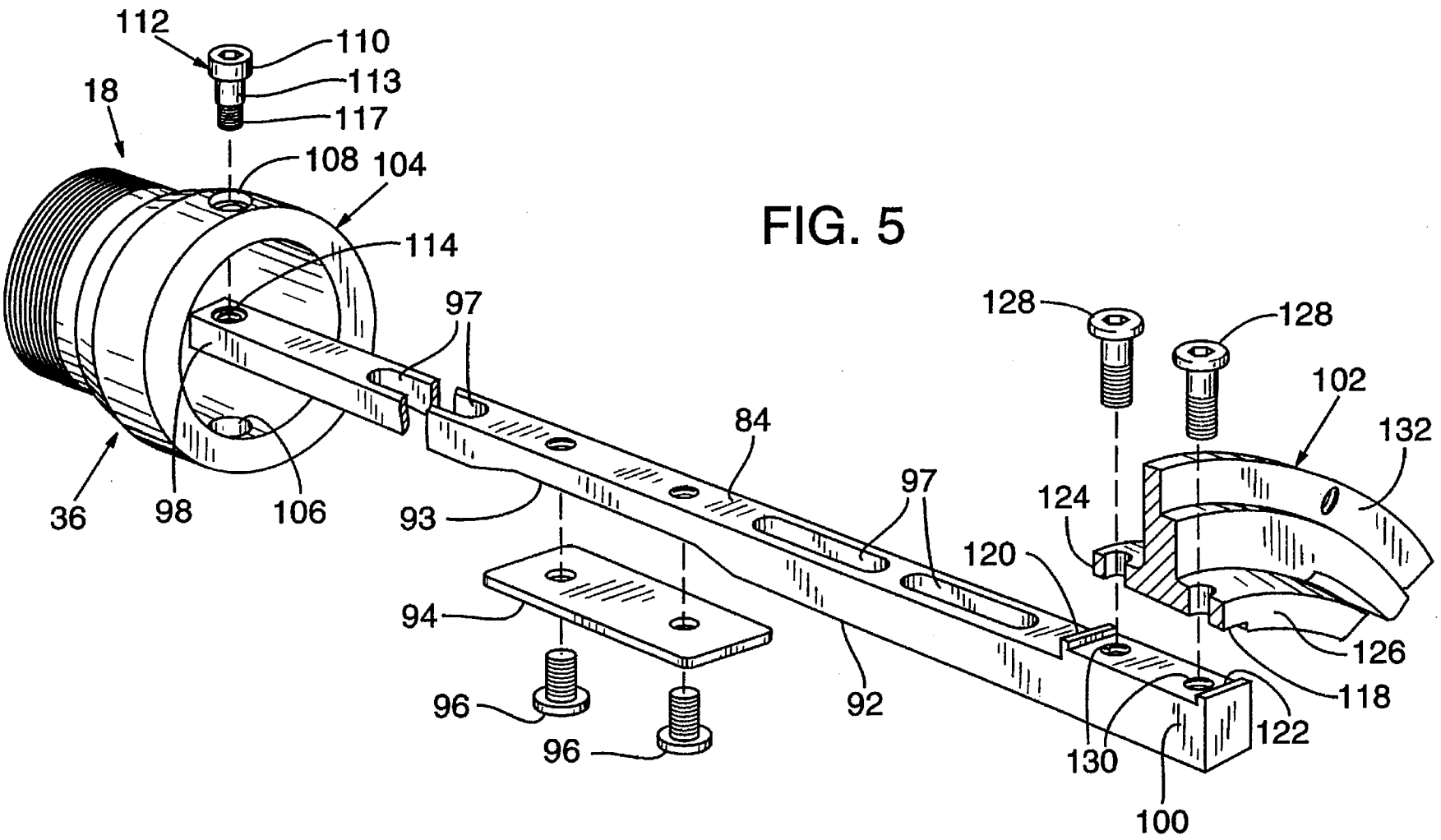
FIG. 5 is an exploded perspective view of one of the shifter bars, illustrating its connection at one end to the interior sleeve of the shifter mechanism, and at the opposite end to the saw-supporting collar.
Figure 6:
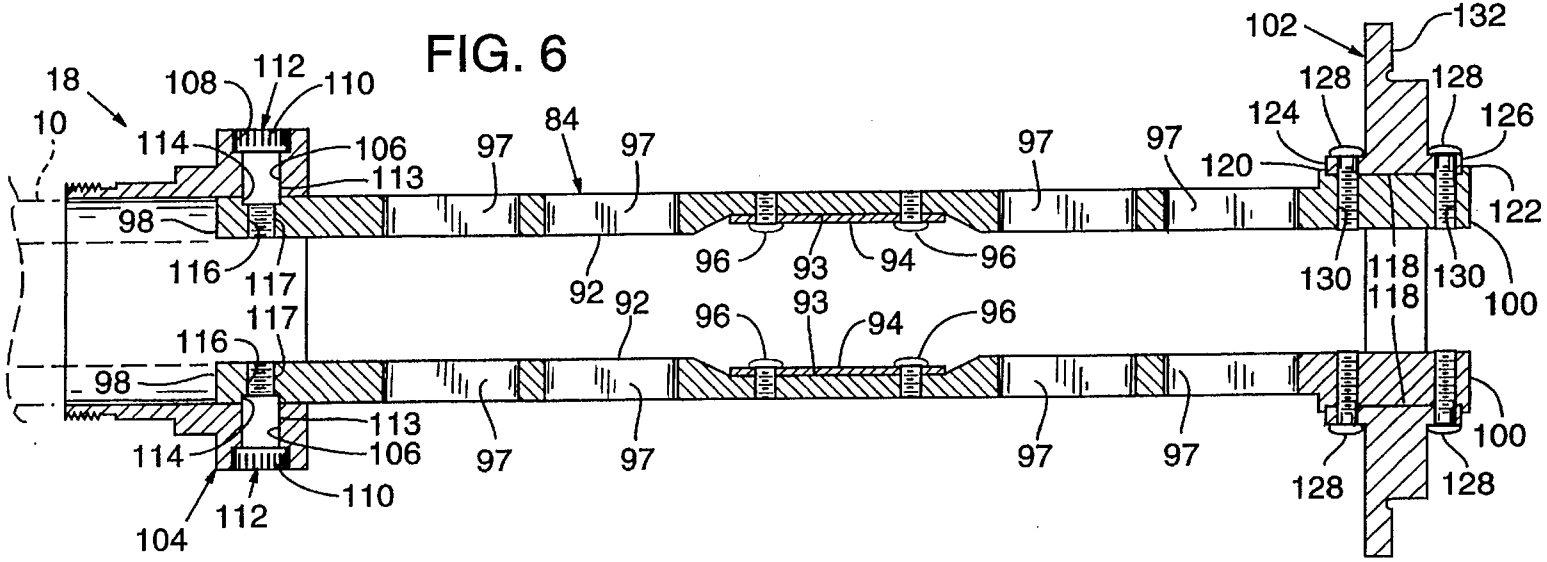
FIG. 6 is a vertical sectional view through FIG. 5.
Figure 7:
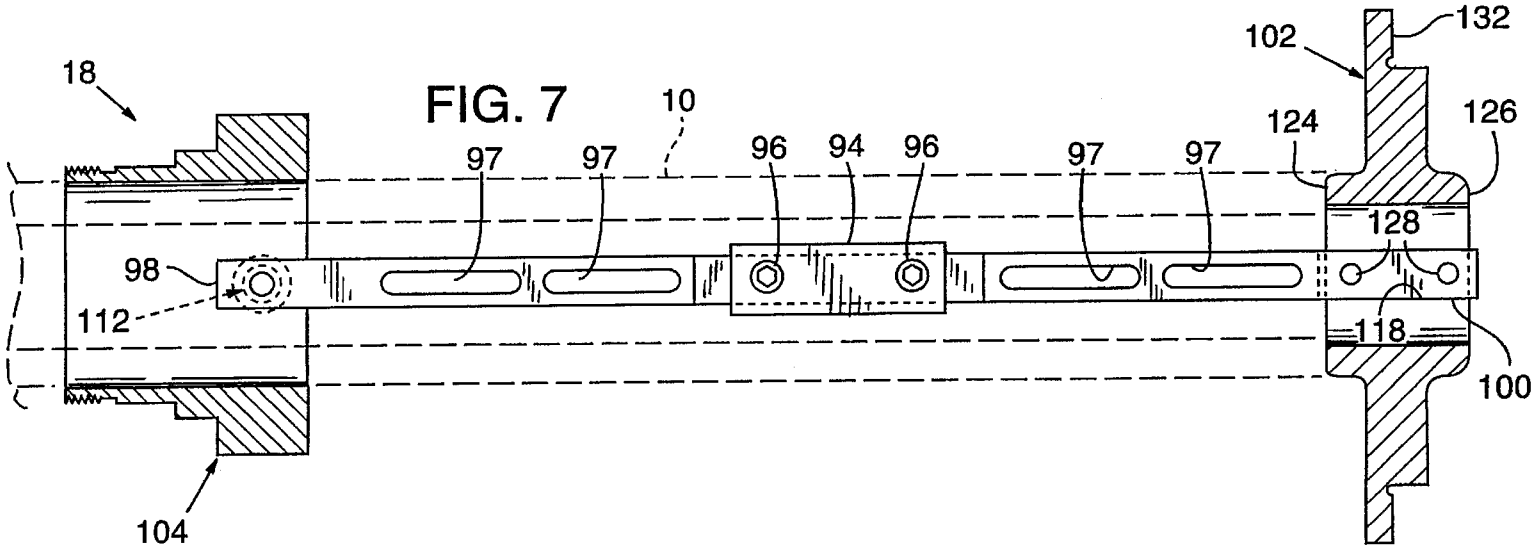
FIG. 7 is a horizontal sectional view through FIG. 6.

The configuration of shifter bars 84, 86, 88 and 90 is a feature of this invention and is shown in FIGS. 5, 6 and 7. For illustrative purposes, only shifter bar 84, one of the two bars which connects shifter mechanism 18 and saw 28, will be described. In one embodiment, bar 84 is 17.337+0.000–0.001 inches long and is generally of rectangular cross-section, 0.625+0.000 –0.001 inch wide by 0.572+0.000–0.002 inch deep. The interior side 92 is recessed in the middle, as indicated at 93, for attachment of a guide plate 94 by two bolts 96. Guide plate 94 is the only part that rides in interior portion 82 of channel 70 as bar 84 slides therein. In this manner, the friction caused by movement of shifter bar 84 is markedly reduced. In the embodiment described, guide plate 94 is 3.000 inches long by 1.000 inch wide by 0.100+0.000–0.005 inch thick or deep, so it can ride in a portion 82 in channels 70, 72, 74, 76 that is, in this embodiment, 0.156+0.005–0.001 inch deep.

A pair of radially extending weight-reducing holes or recesses 97 are provided in bar 84 on each side of guide plate 94, as shown. See FIGS. 5, 6 and 7. Such weight-reducing holes or recesses 97 are, in the embodiment described, 1.87 inches long by 0.31 inch wide and pass completely through shifter bar 84. Recesses 97 greatly reduce the mass of shifter bar 84, thus reducing not only its weight, but also minimizing the centrifugal force which tends to cause bar 84 to bow outwardly as arbor 10 rotates. However, the one end 98 of shifter bar 84, the one that is attached to shifter mechanism 18, is of solid rectangular cross-sectional shape as is the opposite end 100, which is attached to saw collar 102 supporting saw 28. The details of the connections of bar 84 to shifter mechanism 18 and saw collar 102 are as follows.

As mentioned heretofore, and as best illustrated in FIGS. 2, 5, 6 and 7, arbor-encircling central portion 36 of each shifter mechanism has mounted therewithin a bearing assembly 43 which rotatably supports within the bearing assembly a sleeve 104 which snugly encompasses arbor 10. Sleeve 104 is provided with a pair of radially extending cylindrical recesses 106, which, in the embodiment described, are 0.499+0.0005–0.0005 inch in diameter, each of which has a larger exterior portion 108 to accommodate the head 110 of a bolt 112, whose shoulder 113 (which, in this embodiment, is 0.497+0.001 –0.001 inch in diameter) forms a snug fit with recess 106. End 98 of bar 84 is provided with a complementary radially extending cylindrical recess 114, which, in this embodiment, is 0.499+0.0005–0.0005 inch in diameter, terminating in an interiorly extending threaded bore 116 to receive the threaded end 117 of shoulder bolt 112. Recess 114 also forms a snug fit with shoulder 113 of bolt 112 such that bar 84 is connected to sleeve 104 with no axial or circumferential movement possible therebetween, that is, such that the connection between shifter bar 84 and shifter mechanism 18 is effectively a "zero slack" connection.

The opposite end 100 of shifter bar 84 is also of solid rectangular cross-section and is also provided with a similar "zero slack" connection to saw-supporting collar 102 for saw 28. Collar 102 is provided with an axially extending rectangular slot 118, which, in the described embodiment, is 0.625+0.001–0.000 inch wide (see FIG. 7), into which end 100 of bar 84, which, in this embodiment, is 0.625+0.000–0.001 inch wide, is received with a snug connection, thereby to permit no circumferential movement between bar 84 and collar 102. End 100 is also provided with a pair of axially spaced shoulders or detents 120, 122 which snugly receive opposed faces 124, 126 of collar 102 so as to permit no axial movement between bar 84 and collar 102. In the embodiment described, the axial distance between faces 124 and 126 is 1.9050+0.0000–0.0005 inches, the spacing of detents 120, 122 is 1.9050+0.0005–0.0000 inches and the detents extend 0.062+0.000–0.002 inch along faces 124, 126. In this manner, end 100 of bar 84 is also connected to saw-supporting collar 102 with a "zero slack" connection. Connection between bar 84 and collar 102 is maintained by bolts 128, received by threaded bores 130 in end 100 of shifter bar 84, as shown.

Saw-supporting collar 102 includes an annular flange 132 which supports saw 28, saw 28 being retained on flange 132 by a clamp ring 133 (see FIG. 4) in a manner such that saw 28 is positioned at the precise axial midpoint of collar 102. This provides the proper balance for saw 28 and collar 102 such that the saw does not "corkscrew" during rotation of arbor 10.

Shifter mechanism 16 and saw 30 are connected by shifter bars 88, 90 in the same manner as has been described with respect to shifter mechanism 18 and saw 28. Bars 88, 90 are configured similarly to bars 84, 86, except, of course, that they are longer. In the embodiment described, bars 88, 90 are 29.947+0.000–0.001 inches long. Bars 88, 90 are preferably provided with two guide plates 134, and each has the same dimensions as guide plates 94 used with bars 84, 86. Bars 88, 90 are also preferably provided with recesses 97 symmetrically disposed on opposite sides of plates 134. See FIG. 2.

Shifter bars 84, 86, 88, 90 occupy channels 70, 72, 74, 76 in arbor 10, respectively, for movement of saws 28, 30. Similar bars (not shown) occupy the same respective channels in arbor 10 for movement of saws 32, 34.

As respects shifter mechanism 20 and saw 26, instead of a shifter bar connection therebetween, the connection is achieved by means of a tubular extension 138, which is attached directly to the collar 140 for saw 26 in a manner well-known to those skilled in this art.

While a specific embodiment of the invention has been described, it should be apparent that modifications and variations are possible without departing from the invention.

I claim:

1. In a saw apparatus including an elongate power-driven saw arbor, a circular saw-supporting collar and a shifter, each of the collar and the shifter being slidably mounted on the arbor, and at least one elongated compression-transmitting shifter bar extending axially of the arbor and connected at one end to the shifter and at the opposite end to the saw-supporting collar, the arbor having at least one peripheral channel extending axially thereof, the channel having an exterior portion joining the periphery of the arbor and an interior portion of greater width than the exterior portion, the exterior and interior portions providing the channel with a generally T-shaped configuration, the shifter bar being disposed within the channel, the improvement comprising:

a recess disposed in an interior side of the shifter bar, the recess being disposed intermediate the ends of the shifter bar, the recess providing an undercut portion in the shifter bar, at least one guide plate attached to the interior side of the shifter bar at the undercut portion thereof, the guide plate thereby being disposed intermediate the ends of the shifter bar, the guide plate having a width greater than the width of the shifter bar and substantially equal to the width of the greater width interior portion of the channel, the length of the guide plate being substantially less than the length of the shifter bar, only the guide plate being adapted to ride in the greater width interior portion of the channel, whereby the guide plate serves to restrain centrifugal force-induced radial motion of the shifter bar with respect to the arbor during rotation thereof.

2. Apparatus as in claim 1, wherein the shifter bar comprises a generally rectangular cross-section having at least two radially extending recesses therein, the radially extending recesses being disposed in the shifter bar symmetrically on opposing sides of the guide plate.

3. Apparatus as in claim 1, further comprising an interior sleeve in the shifter, the shifter sleeve encircling the arbor, a radially extending cylindrical recess in the one end of the shifter bar, a radially extending cylindrical recess in the shifter sleeve, and a pin member received in the cylindrical recesses in the one end of the shifter bar and in the shifter sleeve, whereby the pin member connects the one end of the shifter bar to the shifter sleeve with no axial or circumferential movement therebetween.

4. Apparatus as in claim 3, wherein the pin member comprises a bolt having a shoulder, the shoulder being received in the cylindrical recesses in the one end of the shifter bar and in the shifter sleeve.

5. Apparatus as in claim 1, wherein the opposite end of the shifter bar comprises a rectangular cross-section and the saw-supporting collar comprises opposed faces, the collar further comprising an axially extending rectangular slot extending between the opposed faces, the opposite end of the shifter bar being received in the slot, whereby the opposite end of the shifter bar is connected to the saw-supporting collar with no circumferential movement therebetween.

6. Apparatus as in claim 1, wherein the guide plate comprises a rectangular guide plate.

7. In a saw apparatus including an elongate power-driven saw arbor, a circular saw-supporting collar and a shifter, each of the collar and the shifter being slidably mounted on the arbor, and at least one elongated compression-transmitting shifter bar extending axially of the arbor and connected at one end to the shifter and at the opposite end to the saw-supporting collar, the arbor having at least one peripheral channel extending axially thereof, the channel having an exterior portion joining the periphery of the arbor and an interior portion of greater width than the exterior portion, the exterior and interior portions providing the channel with a generally T-shaped configuration, the shifter bar being disposed within the channel, the improvement comprising:

at least one guide plate attached to the shifter bar, the guide plate being disposed intermediate the ends of the shifter bar, the length of the guide plate being substantially less than the length of the shifter bar, the guide plate being adapted to ride in the greater width interior portion of the channel, the guide plate serving to restrain centrifugal force-induced radial motion of the shifter bar with respect to the arbor during rotation thereof, the opposite end of the shifter bar comprising a rectangular cross-section, the saw-supporting collar comprising opposed faces, the collar further comprising an axially extending rectangular slot extending between the opposed faces, the opposite end of the shifter bar being received in the slot, whereby the opposite end of the shifter bar is connected to the saw-supporting collar with no circumferential movement therebetween, the opposite end of the shifter bar comprising a pair of axially spaced detents, one of the detents being disposed on the shifter bar at one end of the axially extending slot, the other of the detents being disposed on the shifter bar at the other end of the axially extending slot, each of the detents being disposed so as to engage snugly one of the opposed faces of the saw-supporting collar at each end of the axially extending rectangular slot therein, whereby the opposite end of the shifter bar is connected to the saw-supporting collar with no axial movement therebetween.

8. Apparatus as in claim 6, wherein the saw-supporting collar comprises an annular portion, the annular portion comprising a flange, the flange being adapted to support a saw at the axial midpoint of the saw-supporting collar.

* * * * *